US009392656B2

(12) United States Patent
Angelin et al.

(10) Patent No.: US 9,392,656 B2
(45) Date of Patent: Jul. 12, 2016

(54) METHOD OF DRIVING LED LIGHTING SOURCES AND RELATED DEVICE

(75) Inventors: Francesco Angelin, Treviso (IT); Paolo De Anna, Treviso (IT); Felix Franck, Munich (DE); Enrico Raniero, Padua (IT)

(73) Assignee: OSRAM GmbH, Munich (DE)

( * ) Notice: Subject to any disclaimer, the term of this patent is extended or adjusted under 35 U.S.C. 154(b) by 301 days.

(21) Appl. No.: 14/123,237

(22) PCT Filed: May 31, 2012

(86) PCT No.: PCT/IB2012/052731

§ 371 (c)(1),
(2), (4) Date: Dec. 2, 2013

(87) PCT Pub. No.: WO2012/164511

PCT Pub. Date: Dec. 6, 2012

(65) Prior Publication Data

US 2014/0111102 A1 Apr. 24, 2014

(30) Foreign Application Priority Data

Jun. 3, 2011 (IT) ..... TO2011A0486

(51) Int. Cl.
*H05B 37/00* (2006.01)
*H05B 33/08* (2006.01)

(52) U.S. Cl.
CPC ..... *H05B 33/0821* (2013.01); *H05B 33/0815* (2013.01); *H05B 33/0827* (2013.01)

(58) Field of Classification Search
CPC ..... H05B 33/0809; H05B 33/0845; H05B 33/0821
USPC ..... 315/186, 185 R, 291, 294, 297
See application file for complete search history.

(56) References Cited

U.S. PATENT DOCUMENTS

| | | | | |
|---|---|---|---|---|
| 6,621,235 | B2 | 9/2003 | Chang | |
| 7,317,287 | B2 | 1/2008 | Blumel | |
| 8,547,031 | B2 | 10/2013 | Hying | |
| 2010/0156177 | A1 | 6/2010 | Chien et al. | |
| 2010/0164403 | A1* | 7/2010 | Liu | H05B 33/086 315/297 |
| 2010/0295472 | A1* | 11/2010 | Wibben | H02M 3/158 315/294 |
| 2010/0315013 | A1 | 12/2010 | Li et al. | |

FOREIGN PATENT DOCUMENTS

| | | | |
|---|---|---|---|
| CN | 101772237 | A | 7/2010 |
| WO | 2010000333 | A1 | 1/2010 |

OTHER PUBLICATIONS

Chinese Office Action based on Application No. 201280027061.6(10 pages) dated Mar. 4, 2016 (Reference Purpose Only).

* cited by examiner

*Primary Examiner* — Lincoln Donovan
*Assistant Examiner* — Thomas Skibinski
(74) *Attorney, Agent, or Firm* — Viering, Jentschura & Partner mbB

(57) ABSTRACT

An arrangement for driving a light source, including a plurality of LED strings by means of a current generator, wherein each said LED string forms a respective current mesh with said current generator, includes: at least one inductor acting on said current meshes, in each of said current meshes, an electronic switch having a first, working node towards the LED string and a second, reference node opposed to the LED string.

All the reference nodes of all the electronic switches are connected together, and the working node of each electronic switch is connected to the work node of at least another one of the electronic switches via at least one current averaging capacitor.

The electronic switches can be selectively rendered conductive, each one at a respective time interval, thereby selectively distributing the current of the current generator over the LED strings.

10 Claims, 6 Drawing Sheets

METHOD OF DRIVING LED LIGHTING SOURCES AND RELATED DEVICE

RELATED APPLICATIONS

This application is a national stage entry according to 35 U.S.C. §371 of PCT application No.: PCT/IB2012/052731 filed on May 31, 2012, which claims priority from Italian application No.: TO2011A000486 filed on Jun. 3, 2011.

TECHNICAL FIELD

The present disclosure relates to techniques for driving light sources.

Various embodiments may refer to driving techniques for LED lighting sources.

BACKGROUND

In implementing LED light sources, arrangements are conventionally resorted to which comprise plural LED "strings", which are fed by one and the same supply source.

Strings may differ from one another in various respects, for example in the number and kind of LEDs, in the operating temperatures and other parameters, so that voltage across a string can be different from the voltage across the other string(s).

For this reason, a solution of directly connecting in parallel strings with one another turns out not to be viable (even when an ideal or quasi-ideal current generator is used as a supply source), because the supply power is ultimately distributed to the various strings in an uncontrolled fashion.

The diagrams and FIGS. 1 to 3 show various solutions that can be used to ensure a better uniformity in power distribution on plural LED strings, denoted in general by references K1, K2, . . . , Kn, wherein n can virtually be any number higher than one.

In the diagrams of FIGS. 1 to 3 (as in the other Figures annexed to the present disclosure), the supply generator is shown ideally as in parallel between an ideal current generator, adapted to generate a current I, and a capacitor $C_I$.

The three diagrams of FIGS. 1 to 3 have a current regulator associated to each string K1, K2, . . . , Kn.

This can be achieved, for instance:

- by simply resorting to a resistor R1, R2, . . . , Rn, as shown in FIG. 1,
- in the form of an active linear regulator (for example a bipolar transistor Q1, Q2, . . . Qn), as shown in FIG. 2,
- by using more complex switching regulators, for example in the form of buck converters comprising, for each string K1, K2, . . . , Kn, an inductor L1, L2, . . . , Ln and a switch Q1, Q2, . . . Qn (e.g. a mosfet) adapted to be traversed by the current flowing in the LED string K1, K2, . . . , Kn, as well as a freewheeling diode D1, D2, . . . , Dn, as shown in FIG. 3.

In the latter arrangement there is moreover provided a current measure and control circuit (denoted in FIG. 3 as CMC, i.e. Current Measure and Control) which, on the basis of the intensity of the current traversing the various strings K1, K2, . . . , Kn, as detected via sensors or probes P1, P2, . . . , Pn (of any known kind) performs a corresponding function of current control in the various strings K1, K2, . . . , Kn, by opening and closing Q1, Q2, . . . , Qn according to need.

The exemplary solutions shown in the diagrams of FIGS. 1, 2 and 3 suffer from various drawbacks.

Specifically, the solutions implementing a linear control function (see FIGS. 1 and 2), if on one hand are easy to implement, have the intrinsic disadvantage of causing a power dissipation which is proportional to the operating voltage difference of the various strings K1, K2, . . . , Kn and to the work current of such strings, such power being completely lost. A solution as shown in FIG. 1 has moreover the drawback of needing a virtually fixed compensation mechanism.

Switching solutions such as shown in FIG. 3 involve the presence of an additional "intelligence", in order to identify which sets of the various switches Q1, Q2, . . . , Qn must be kept closed at any time and which ones must be kept opened, in order to perform the balancing function needed, according to the control requirements provided by the CMC module. Moreover, in solutions as shown in FIG. 3, each regulator must be able to manage all the power involved in the operation of the string to which the switch is coupled.

Solutions which substantially derive from the current mirror arrangement of FIG. 2 are described in documents such as U.S. Pat. No. 7,317,287 or U.S. Pat. No. 6,621,235.

The state of the art comprises moreover document WO-A-2010/000333 (which substantially reproduces the arrangement in FIG. 2, i.e. the use of analogically driven transistors).

To complete the survey we refer to the solution disclosed in document US-A-2010/0315013, which is based on the use of a switching converter, which can be broadly defined as a series/parallel converter typically comprising a transformer for each string.

SUMMARY

On the basis of the foregoing description, the need is felt for solutions which overcome the previously outlined drawbacks.

According to the disclosure, various embodiments provide a method. The disclosure moreover concerns a related device.

Various embodiments achieve a current balance with a proportional distribution of the current on two or more LED strings operating at different voltages; in other words, various embodiments can divide the current coming from the supply source onto two or more LED strings, which are adapted to operate in parallel, so as to compensate for the voltage differences among the strings.

Various embodiments can have a simplified arrangement, aiming at dividing into two equal parts the current supplied towards two strings; in various embodiments the LED strings are arranged with a common anode.

In various embodiments, the supply source can be a current generator with slow dynamics, i.e. a generator adapted to supply a controlled average current to the overall load made up by the various LED strings.

In various embodiments, such a generator can be considered in some respects—in its behaviour in case of quick impedance variations in the load—as a voltage generator which can be regarded as an ideal current generator, adapted to generate a current with intensity I, connected in parallel to a capacitor $C_I$.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION

In the following description, numerous specific details are given to provide a thorough understanding of embodiments. The embodiments can be practiced without one or several specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

Figure 1:
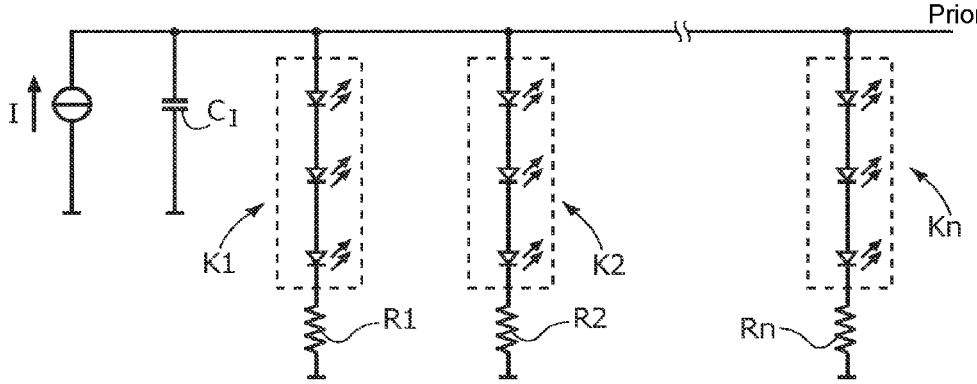
FIG. 1 Prior Art
FIGS. 1 to 3 have already been described in the foregoing.
Figure 2:
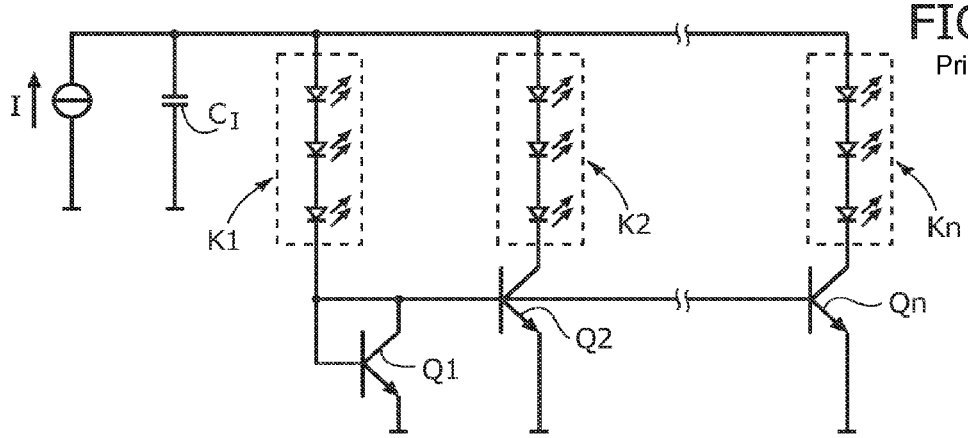
FIG. 2 Prior Art
Figure 3:
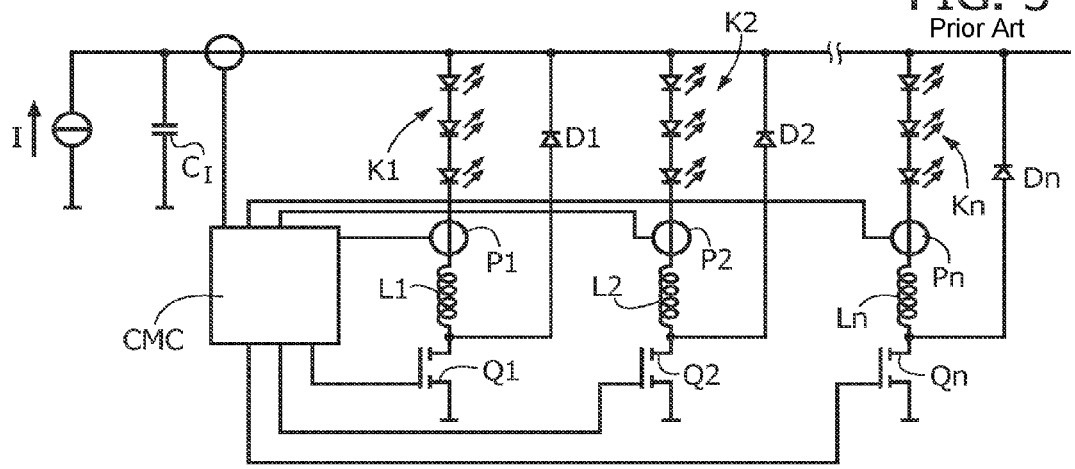
FIG. 3 Prior Art

In FIGS. 4 to 14 parts, elements or components which have already been described with reference to FIGS. 1 to 3 are denoted by the same references previously used in such Figures; the description of such previously described elements will not be repeated in the following in order not to overburden the present detailed description.

Again, for clarity of description, it is to be noted that in FIGS. 4 to 14 elements, parts or components which are mutually identical or equivalent are denoted by the same references, so that the description of one of such parts, elements or components, provided with reference to one of such Figures, will not be repeated in the remaining Figures.

FIGS. 4 to 14 refer to devices for supplying lighting sources, comprising a plurality of LED strings K1, K2, . . . , Kn (n being ≥2), from a supply source which is shown schematically (for previously mentioned reasons) in the form of an ideal current generator, generating a current I, having a capacitor $C_I$ connected in parallel. This illustration takes into account the effect of reduced dynamics of a real generator, which is typically a voltage generator with a regulation of the current average value (which determines the intensity of light flow from LEDs in strings K1, K2, . . . , Kn) and which therefore is not adapted to change its output voltage instantly.

In the annexed Figures there are shown electronic switches S1, S2, . . . , Sn, adapted in various embodiments to be implemented as electronic controlled switches, for example in the form of mosfets, or as diodes operating as switches.

In various embodiments, the use of mosfets to implement electronic controlled switches can take into consideration the fact that a mosfet (when it is "open", i.e. non-conducting) in all instances contains an antiparallel diode (named "body", due to the physical implementation of the mosfet itself), which can accept a certain degree of reverse conduction.

In order to have an electronic switch with bilateral behaviour (i.e. having a voltage/current characteristic curve which is symmetrical over origin and therefore adapted to ensure, when open, non-conduction in both senses) it is possible to use a series connection of a mosfet and a diode (this solution can be resorted to in various exemplary embodiments described in the following, wherein the conduction in the other sense is not essential).

The possibility to obtain intrinsically bilateral devices, with GaN technology, is discussed in literature. The possibility moreover exists to implement such a switch with a simple bipolar transistor (BJT, e.g. n-p-n), for example when it is possible to ensure that the difference between the voltages of the various strings does not exceed the base-emitter junction breakdown. It is moreover possible to use such a transistor in reverse active area (i.e. by exchanging collector and emitter) in order to reduce the saturation voltage (however with the disadvantage of a higher base current).

In the following, the reference to electronic switches embodied by mosfets must therefore be understood as a reference for the sake of brevity and simplicity of illustration, while keeping in mind the aspects of practical implementation which have already been described.

Various presently described embodiments principally deal with the aspect of distributing current I produced by such a generator.

In the following, reference will be made for simplicity to a broad value I which is assumed to be constant. Of course, various embodiments as presently considered can be used in combination with arrangements wherein the (average) intensity of current I can be selectively regulated, for example resorting to a pulse width modulation (PWM), in order to vary the light flow produced by the light source comprising the various strings K1, K2, . . . , Kn. On the other hand, such a pulse width modulation can be performed in addition to the driving function of switches S1, S2, . . . , Sn, which will be better detailed in the following.

Various presently considered embodiments are essentially based on three features:

- arranging at least one single inductor for all strings (see the inductor denoted as L in some Figures), or divided into respective inductors for the various strings (see the inductors denoted as L1, L2; L1, L2, L3), in the path followed by the current while it flows through the LED strings K1, K2, . . . , Kn,
- selectively distributing current supply I to LED strings denoted by K1, K2, . . . , Kn, so that, at a given time instant, only one of the strings K1, K2, . . . , Kn be supplied by current generator I, and
- associating, to the LED strings of capacitors C1, C2, . . . , Cn, the function of a current averaging capacitor, i.e. a function of averaging the current flowing through the LED strings.

In various embodiments, in order to selectively distribute the supply current I to the various LED strings, a respective electronic switch S1, S2, . . . , Sn is associated to each string K1, K2, . . . , Kn.

Through a sequencer SE it is therefore possible to coordinatively drive such switches so that, at any given instant, only one of switches S1, S2, . . . , Sn is in a closed state, so that the LED string to which it is associated be supplied with the current coming from generator I for a time interval t.

Figure 5:
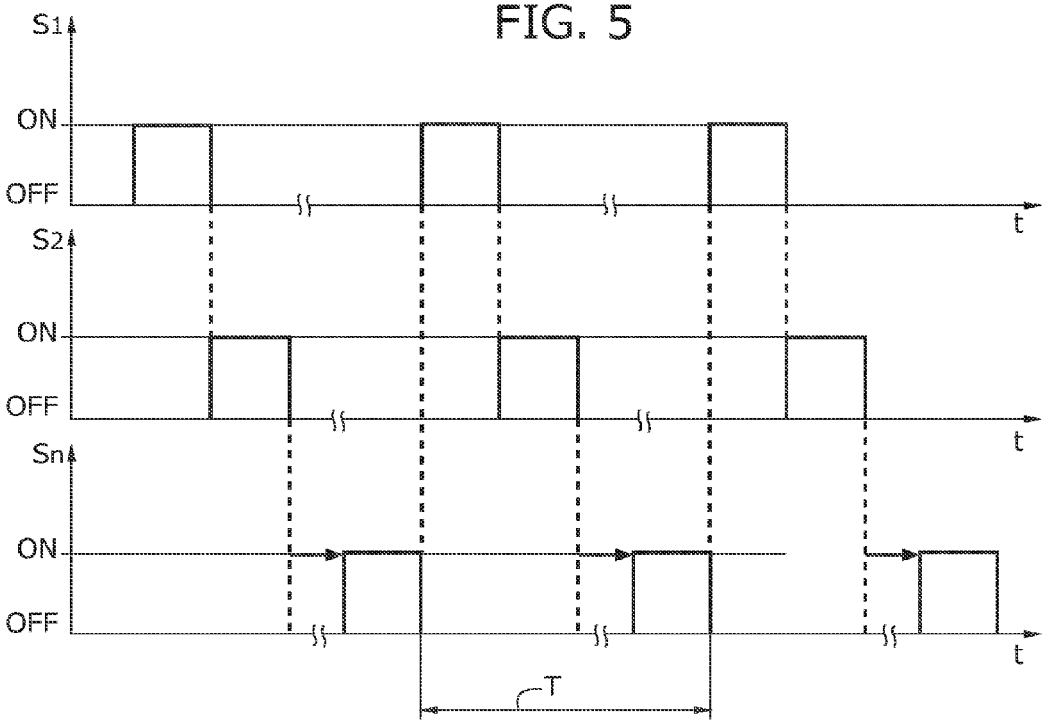
FIG. 5 shows current patterns in an embodiment.

In this way, current I is selectively distributed to the various strings K1, K2, . . . , Kn, as schematically shown in FIG. 5.

In this Figure, the overlapped diagrams show the different switches S1, S2, . . . , Sn switching from an open state (non-conducting), denoted by OFF, and a closed state (conducting) ON. As has already been stated, switching is performed by activating, at each time interval, one and only one of the switches S1, S2, . . . , Sn for supplying current to the respective string K1, K2, . . . , Kn.

The switching to open and closed states of a single switch takes place within a given period T (in various embodiments, such a period can be of the order of a few μs).

It will be appreciated that, in various embodiments, in choosing the value of such a period the need can be neglected of taking into account possible flickering events: in various embodiments the current on the LEDs is actually "averaged", i.e. levelled, by capacitors C1, C2, . . . , Cn.

The presence of one or more inductors within a switching arrangement aims at keeping the current from the generator constant.

The statement that such an inductor has the function of keeping generator current I "constant" refers to a model of ideal behaviour; actually, such a current is subject to very rapid variations, which however have a limited width as compared to the average value. It is therefore a current with an overlapping ripple of reduced width.

The smaller t (i.e. the interval of current injection into a single string K1, K2, . . . , Kn), the smaller Δt, so that, if the variation is very small, the corresponding current can be considered as virtually "constant".

In practice, the current supplied to each string K1, K2, . . . , Kn is proportional to the duty cycle of the corresponding switch S1, S2, . . . , Sn, i.e., with reference to the example of FIG. 5, to the ratio between time interval $t_i$, wherein the $i^{th}$ switch Si is closed, and the time period T. In this way, the current flowing through the $i^{th}$ string Ki (i=2, . . . , n) has a value $I_{Si}$ which equals the value of current I produced by the generator, multiplied by the ratio between interval $t_i$ and time period T, i.e., in broad terms: $I_{Si}=I*t_i/T$, with $T=\Sigma t_i$.

For example, assuming the presence of four strings K1, K2, K3 and K4, and assuming that they all operate with a duty cycle (ratio $t_i/T$, of course always ≤1) of 0.25, it is possible to divide current I exactly by sending one fourth of the whole amount to each string, so that, for example, if the generator current I has an intensity of 1 A, each string K1, K2, K3, K4 receives 250 mA.

In various embodiments, the duration of interval $t_i$ while switch Si is closed can be determined differently for each single string, with a corresponding variation of the value of current $I_i$ flowing through the single string.

The diagrams in FIGS. 6 to 14 refer to various possible embodiments which are derived from the previously disclosed basic principle.

In this respect it will be appreciated that specific details of implementation of an embodiment shown in one of the annexed Figures are in general freely applicable to other embodiments shown in other Figures.

Figure 4:
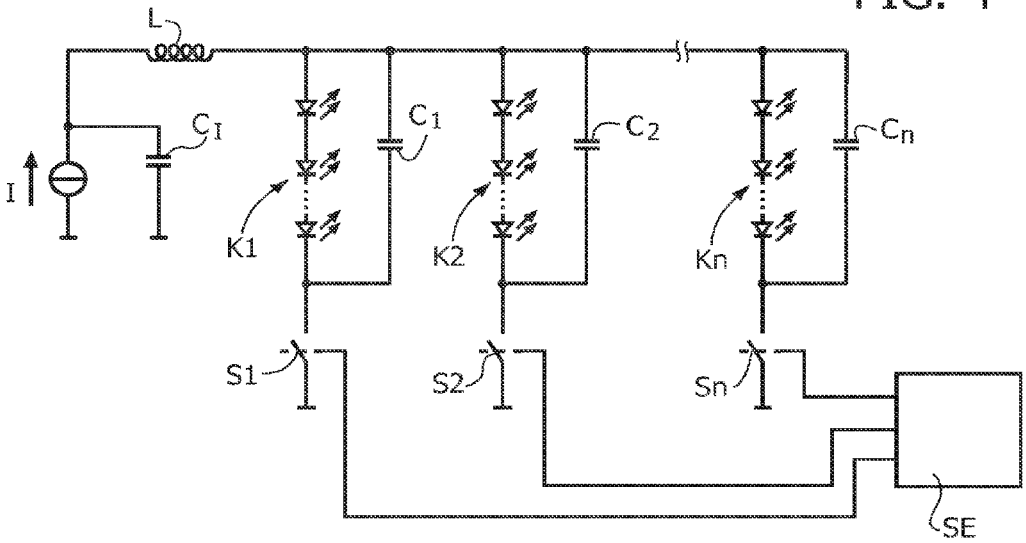
FIG. 4 is a circuit diagram of an embodiment.
Figure 6:
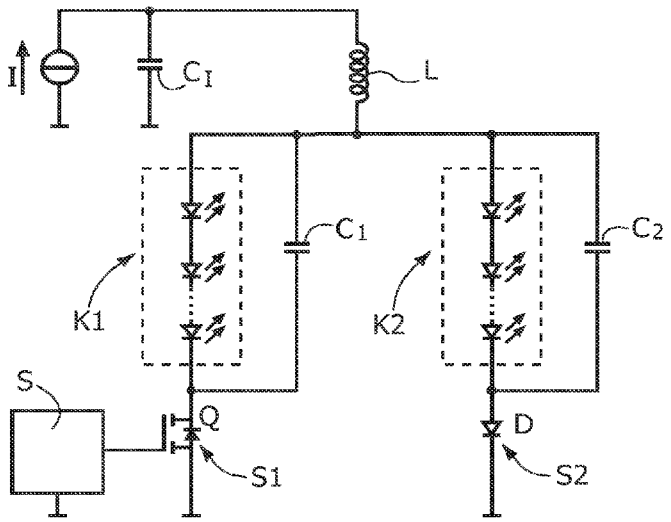
FIG. 6 is a circuit diagram of an embodiment.

The diagram in FIG. 6 follows the general arrangement of FIG. 4 as concerns the use of capacitors C1, C2, . . . , Cn, having the function of obtaining an average of the pulse current applied by the respective switch to the respective LED string, so as to reduce the current ripple to an acceptable level for the application, while disclosing at the same time the possibility of reducing the general arrangement of FIG. 4 to only two strings K1 and K2.

In the embodiment of FIG. 4, switches S1, S2, . . . , Sn (i.e. Si, with i=1, 2, . . . , n) are shown as controlled switches, e.g. based on the use of mosfets (we refer to the previous statements regarding the presence of a body diode).

When they are open (i.e., OFF), such controlled switches do not conduct current in either sense, and therefore they prevent instant discharge of capacitors C1, C2 (or in general C1, C2, . . . , Cn) connected in parallel to strings S1, S2, . . . , Sn.

FIG. 6 shows moreover the possibility to implement one of the switches shown therein, for example switch S2, simply as a diode D, while switch S1 is shown in the form of a controlled switch, for example as a mosfet driven by sequencer S.

This simplified implementation may be adopted, for example, if one of the strings (e.g., in FIG. 6, string K2) has a voltage drop thereacross which is higher than the other string K1.

In this case, in order to drive string K1 a simple mosfet is sufficient, reversibility being not required when the voltage across the string driven by the same mosfet is lower that the voltage connected to the diode.

The fact that string K2 shows (for example with the same supply current) a voltage drop thereacross which is higher than in string K1 may be due, for example, to the fact that string K2 comprises a higher number of LEDs (being "longer" in the present case), but it may also be due to the different types of LEDs which make up the two strings K1 and K2.

In the exemplary embodiment of FIG. 6, sequencer S can simply be implemented by an oscillator, which (only) drives switch S1 (e.g. a mosfet Q) with a 50% duty cycle.

In such an exemplary embodiment, diode D (switch S2):

- automatically switches to conducting (ON), supplying string K2, when sequencer SE has driven the opening (OFF) of mosfet Q (switch S1);
- automatically opens (OFF), interrupting the current supply to string K2, when sequencer SE has driven the closing (ON) of mosfet Q (switch S1).

Figure 7:
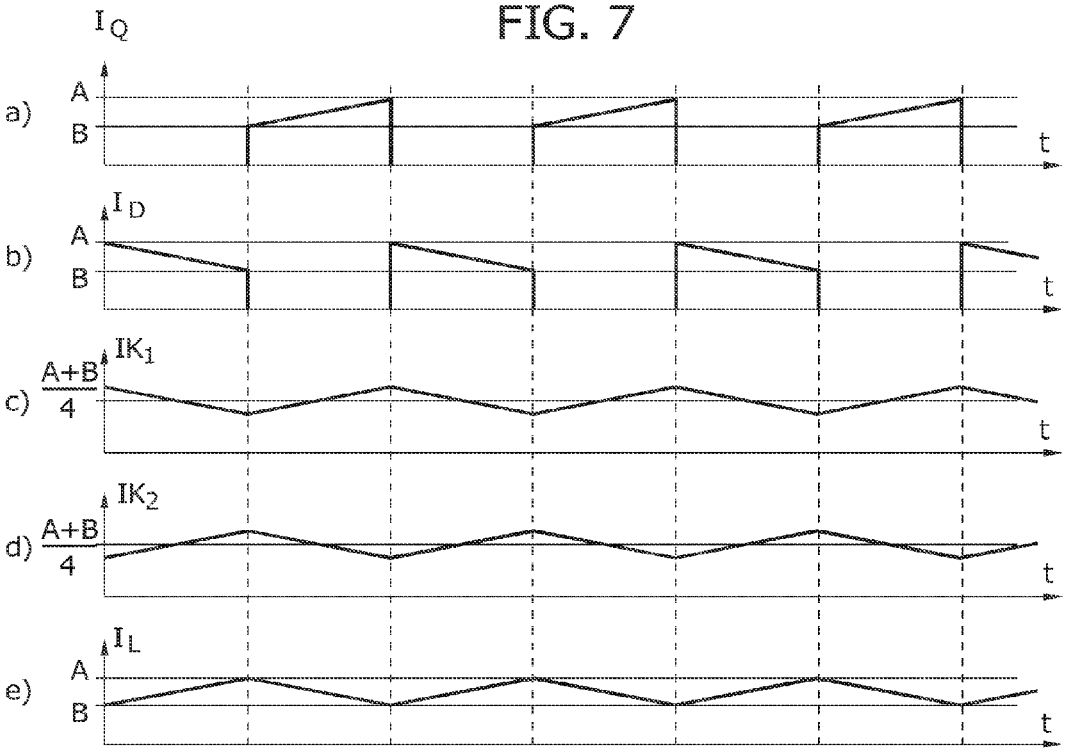
FIG. 7 shows current patterns in an embodiment.

Diagram a) of FIG. 7 shows the pattern of current $I_Q$ through mosfet Q (switch S1) according to the "simplified" embodiment of FIG. 6, wherein only two strings K1 and K2 are present. When switch Q is closed, the current flowing through string K1 and capacitor C1 (i.e., the current flowing through inductor L in such conditions) starts rising at a rate of ΔV/L, i.e. as a function of the ratio between the voltage difference ΔV between the strings K1, K2 and the inductance value of inductor L.

This process lasts for the time interval t wherein switch S1 (mosfet Q) is driven to close by sequencer S. The amount of the variation of current $I_L$ in inductor L (see diagram e) in FIG. 7) is given by the difference between a maximum value A and a minimum value B. Such a difference is generally lower than the value of the "constant" (i.e. slowly changing) current flowing through inductor L; it can be therefore stated that such a current is at least approximately constant.

When switch Q opens, inductor L tends to keep the value of the current flowing through inductor L itself, while raising the inner voltage at the anode of diode D, until diode D is caused to close (i.e. to become conductive). Generator current I, which can no longer flow through string K1 because switch Q is open, as a consequence flows through string K2 and capacitor C2, as shown in diagram b) of FIG. 7. The current flowing through string K2 tends to decrease in intensity, until it reaches the original starting point before mosfet Q (switch S1) was closed, and the described cycle is repeated with period T.

In practice, capacitors C1 and C2 of FIG. 6 perform an averaging function on the current, in the corresponding LED strings K1 and K2, storing charge when the respective switch is closed and releasing such charge when the switch is open. The current traversing both strings K1 and K2 has therefore the pattern schematically shown in diagrams c) and d) of FIG. 7 (wherein the ripple amount has been emphasized on purpose, for clarity of representation), with the consequent result of equally distributing the input current I between both strings K1 and K2.

What has been previously stated with reference to the role of capacitors C1 and C2, associated to strings K1 and K2 of FIG. 6, is of course valid in case wherein n capacitors C1, C2, . . . , Cn are provided, in association to n strings K1, K2, . . . , Kn.

Through capacitors C1, C2, . . . , Cn it is possible, on the basis of the acceptable size, to achieve a corresponding reduction of the current ripple through strings K1, K2, . . . , Kn, whose pattern has been emphasized on purpose (with reference to an exemplary embodiment with only two strings K1 and K2) in diagrams c) and d) of FIG. 7.

The described effect of ripple reduction (which is more marked as the capacitor capacity increases) can be achieved by coupling respective capacitors C1, C2, . . . , Cn to a corresponding number of strings S1, S2, . . . , Sn, whatever the value of n.

It is also possible to extend the idea at the basis of the use of diode D in the diagram of FIG. 6 to other arrangements, wherein more than two strings K1, K2, . . . , Kn are present.

Figure 8:
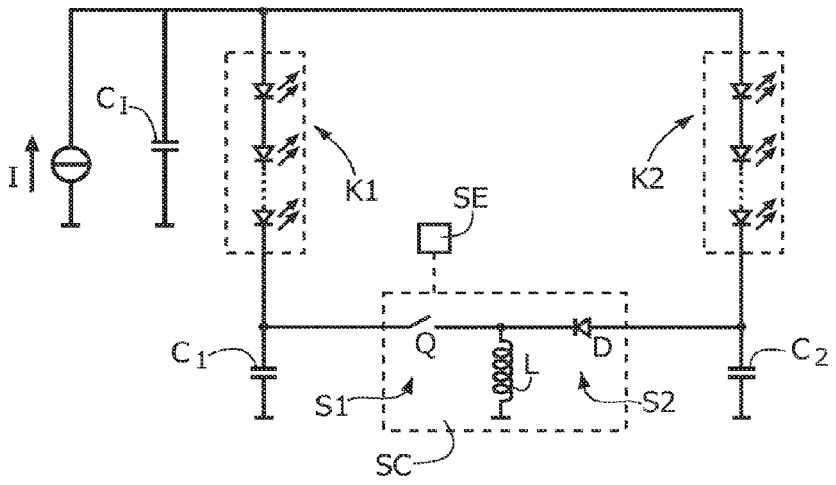
FIG. 8 is a circuit diagram of an embodiment.

The diagram in FIG. 8 shows a possible variation in the arrangement of FIG. 6. In FIG. 8, inductor L (which in the diagram of FIG. 6 is interposed between the generator, producing current I, and strings K1 and K2) is shown between the strings K1 and K2 and ground, specifically so that the terminals of switches S1 (mosfet Q) and S2 (diode D), opposed to strings K1 and K2, instead of being directly referred to ground, are referred to ground through inductor L.

In the diagram of FIG. 8, therefore, strings K1 and K2 are interposed between the current generator I and inductor L.

In the diagram of FIG. 8, capacitors C1 and C2 (which in the diagram of FIG. 6 are connected in parallel to strings K1 and K2, respectively) are interposed between the respective string K1, K2 and ground, so that strings K1 and K2 are in turn interposed between respective capacitors C1 and C2 and generator I.

Once again it is to be reminded that specific details or implementations described with reference to any of the annexed Figures are liable to be transferred (individually or in combination) to the embodiments of the other Figures as well.

Although based on the same operating principle, the circuit arrangement of FIG. 8, if compared with the circuit of FIG. 6, involves a new layout of components, according to more conventional solutions: specifically, elements Q (switch S1), D and L (switch S2) can be grouped in a sort of switching cell SC, so as to ease the evaluation of the managed power.

Cell SC performs a balancing function on power between the two loads of strings K1 and K2; this function is achieved without referring to the input voltage, in its absolute value, but referring instead to the operating voltage difference $\Delta V$ between the two strings: therefore, cell SC is adapted to be implemented with components sized to resist reduced voltages (essentially the voltage differences across the strings), but not sized to bear the whole voltage value and therefore the whole power.

Figure 9:
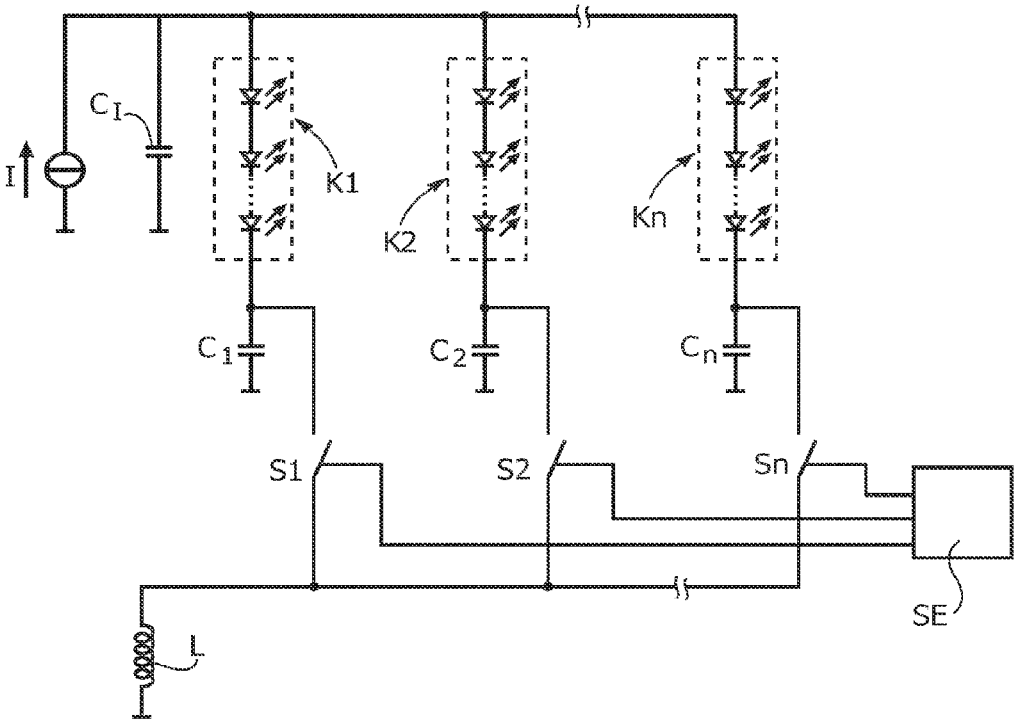
FIG. 9 is a circuit diagram of an embodiment.

The diagram in FIG. 9 can be seen as a generalization of the diagram in FIG. 8, in the presence of a general number $n>2$ of LED strings. Specifically, the diagram in FIG. 9 refers to the implementation of the various switches S1, S2, . . . , Sn as electronic switches, which are driven by sequencer SE.

It is therefore an exemplary embodiment which is based substantially on the diagram of FIG. 4, therefore disregarding (unlike in FIG. 6, as for the possibility to use a diode D as a switch S2) any specific prerequisite on the length and on the operating voltages of the various strings K1, K2, . . . , Kn.

Figure 10:
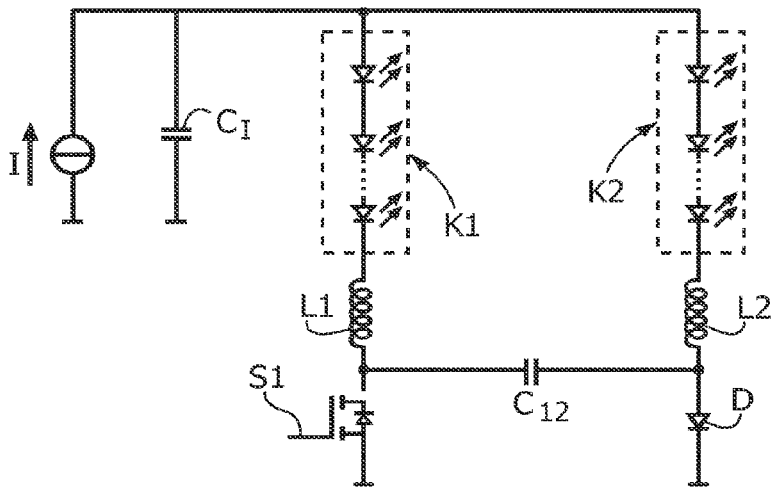
FIG. 10 is a circuit diagram of an embodiment.
Figure 11:
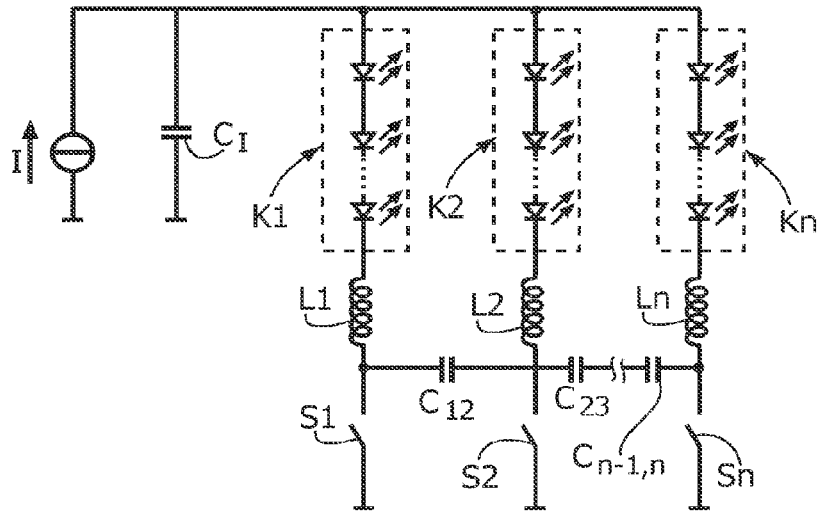
FIG. 11 is a circuit diagram of an embodiment.
Figure 12:
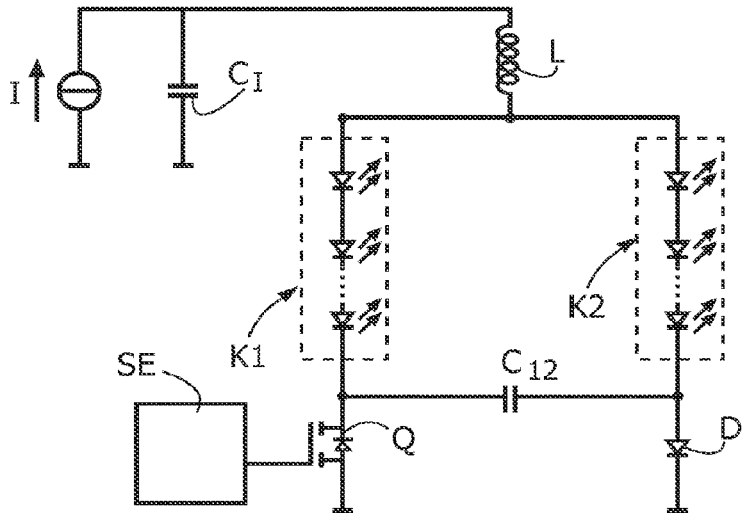
FIG. 12 is a circuit diagram of an embodiment.

The diagrams in FIGS. 10 to 12 show further possible embodiments relating to the same basic principle of FIG. 4.

The diagram in FIG. 10 shows the possibility to modify an arrangement which broadly corresponds to the one shown in FIG. 6 by so to say "splitting" inductor L into two "partial" inductors L1 and L2, each of them being connected in series to a respective LED string K1, K2, and by exchanging capacitors C1, C2 connected in parallel to the respective strings K1, K2, with a capacitor C12 arranged bridge-like between the terminals of inductors L1 and L2 opposed to strings K1 and K2.

FIG. 11 shows the theoretical possibility to generalize the use of the connection topology of capacitor C12 referring to an exemplary embodiment wherein n LED strings K1, K2, . . . , Kn are provided, in association with respective inductors L1, L2, . . . , Ln.

The terminals of the inductors involved which are opposed to the strings K1, K2, . . . , Kn are connected to each other in pairs by respective capacitors C12, C23, . . . , Cn−1, n.

Again, always referring to FIG. 11, when it is broadly known that a particular string, for example string Kj (j=1, . . . , n) has a voltage drop which is higher than all the other strings in any load conditions, it is possible to use, instead of switch Sj associated therewith, a simple diode, by virtually substituting at the level of sequencer SE the respective driving signal to close the switch with a dead time, and implementing the other switches as bilateral switches (for example in the form of a mosfet with a diode in series, to take into account the effects of the conducting body diode, which have been repeatedly described in the foregoing).

To further demonstrate the previously mentioned possibility to transfer specific features from one of the described embodiments to another, FIG. 12 shows the possibility to use, in an arrangement substantially corresponding to the diagram of FIG. 10, a solution of "combining" both inductors L1 and L2 which in FIG. 10 are arranged in series, respectively to string K1 and string K2, into a single inductor L, which is interposed between current generator I and LED strings K1 and K2.

Figure 13:
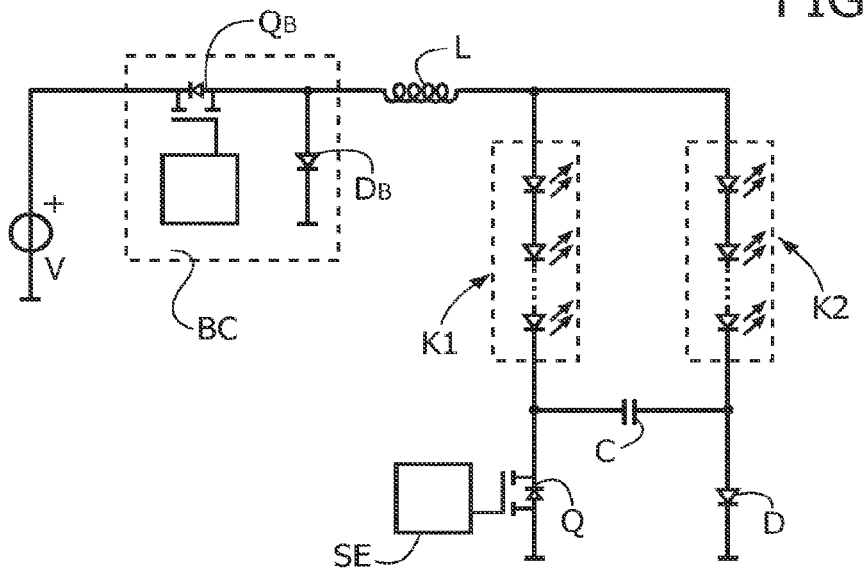
FIG. 13 is a circuit diagram of an embodiment.

FIG. 13 shows the possibility to use as an inductor L the same inductor of the switching output stage of current generator I, for example in the form of a buck converter, denoted by BC, without an output capacitor.

Figure 14:
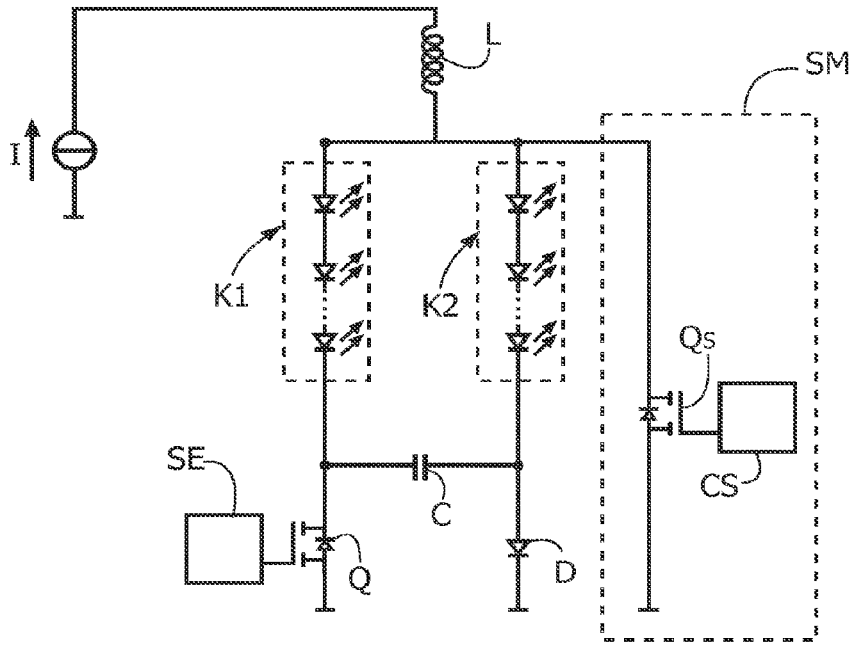
FIG. 14 is a circuit diagram of an embodiment.

In the same way, FIG. 14 shows the possibility (referring to the circuit solution of FIG. 12; however, the example can be transferred to the other embodiments) of superposing a "shorting" pulse width modulation (for example applied through a shorting modulator SM, comprising an electronic switch Qs driven by a respective drive circuit CS) so as to vary the average current I; this result can be achieved as well by controlling such current at the level of the respective generator.

This is a further example of the previously described possibility to transfer specific features of implementation from one to the other presently considered embodiments, while preserving the general criterion at the basis of each and every described embodiment, with the aim of driving a light source comprising a plurality of LED strings, i.e. strings K1, K2, . . . , Kn with a current generator I, in an arrangement wherein each LED string K1, K2, . . . , Kn forms with current generator I a respective current mesh.

The concept of "mesh" (or "loop") is well known in the field of circuitry: see for example the IEEE Standard Dictionary of Electrical and Electronic Terms (IEEE Std 100 270-1966w) which defines a mesh as "a set of branches forming a closed path in a network, provided that, if any one branch is omitted from the set, the remaining branches of the set do not form a closed path".

The presently considered embodiments employ therefore at least an inductor, acting on said current meshes. This can be accomplished by providing one single inductor L, coupled to a plurality of current meshes (see for example FIGS. 4, 6, 8, 9, 12, 13 and 14), or by providing a plurality of inductors L1, L2; L1, L2, . . . , each of them being coupled to a respective current mesh (see for example FIG. 10 or 11).

In this respect it is moreover possible both to interpose said at least one inductor L between current generator I and LED strings K1, K2, . . . , Kn (see for example FIGS. 4, 6, 13 and 14), and to provide such at least one inductor with LED strings K1, K2, . . . , Kn interposed between current generator I and the inductor (see for example FIGS. 8, 9, 10 and 11).

Moreover, the presently considered embodiments interpose, in each current mesh, an electronic switch S1, S2, . . . , Sn, having a first, "working" node towards LED string K1, K2, . . . , Kn and a second, "reference" node opposed to LED string K1, K2, . . . , Kn.

The "reference" nodes (i.e. the second nodes) of all electronic switches S1, S2, . . . , Sn are connected together (for example with a common return to ground, as in the case of FIGS. 4, 6, 10, 11, 12 and 14, or else with a common connection to the same component, as in the case of FIGS. 8 and 9).

According to the presently considered embodiments, the "working" node of each electronic switch S1, S2, . . . , Sn is connected to the working node of at least another such electronic switch S1, S2, . . . , Sn via at least one current averaging capacitor C1, C2, . . . , Cn.

This can be accomplished in various ways, for example:

by arranging a current averaging capacitor C1, C2, . . . , Cn in parallel with a respective LED string, as in the case of FIGS. 4 and 6, by having such a respective LED string K1, K2, . . . , Kn interposed between current generator I and the current averaging capacitor, as in the case of FIGS. 8 and 9.

Moreover, it is possible to interpose a current averaging capacitor C12, C23 bridge-like between a pair of LED strings K1, K2; K2, K3, . . . , Kn−1, Kn, preferably with respective inductors L1, L2, . . . , Ln interposed between current generator I and the current averaging capacitors, as in the case of FIGS. 10 to 14.

In this respect it will be appreciated that the described coupling between the work nodes of various switches would not be present if the capacitive path between two "working" nodes involved the reference nodes, because the energy stored in the corresponding capacitor would in that case be shorted by the switches.

Moreover, the presently considered embodiments make electronic switches S1, S2, . . . , Sn selectively conductive only one at a time, for a respective time interval $t_i$, so as to selectively distribute current I to LED strings K1, K2, . . . , Kn. Specifically, it is possible to make switches S1, S2, . . . , Sn conductive in respective time intervals $t_i$, and the duration of said respective time intervals regulates the current distribution on the plurality of LED strings K1, K2, . . . , Kn.

In various embodiments, electronic switches S1, S2, . . . , Sn are provided in the form of electronic controlled switches. In exemplary embodiments such as those considered in FIGS. 6, 8, 10 and 12 to 14, among a plurality of LED strings it is possible to identify at least one first string K1 and a second string K2, in a situation wherein the second LED string K2 has a voltage drop thereacross which is higher than the at least one first LED string K1.

In various embodiments it is then possible to use an electronic controlled switch (for example a mosfet Q) as an electronic switch associated to the first LED string K1, and to use a diode D as an electronic switch associated to the second LED string K2.

Various embodiments achieve one or several of the following advantages:

in the same way as the previously known "linear" solutions:

a) it is possible to determine the size of power components by referring only to the voltage/power differences from one string to the other, and not to the absolute value of the power supplied to the strings;

b) the current is intrinsically distributed with proportional criteria, thanks to a physical mechanism, without the need to resort to controllers with set points and/or current sensors, as is the case for the sensors or probes P1, P2, . . . , Pn of FIG. 3;

as it happens in switching solutions, there is no power dissipation, because the system can be entirely comprised of non-dissipative elements;

particularly in the embodiments with only two strings, in order to achieve power halving, the resulting circuit can be made extremely simple in practice by using, as an active component, a single low voltage mosfet (for example an n-mosfet), combined with a very simple oscillator operating with a 50% duty cycle;

the current distribution criterion can in any case be modified by simply regulating the duty cycle which drives switches S1, S2, . . . , Sn, without having to resort to particularly complex measure components or analogue circuits.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A method of driving a light source including a plurality of LED strings by means of a current generator in an arrangement wherein each said LED string forms a respective current mesh with said current generator, the method comprising:

providing at least one inductor acting on said current meshes, inserting in each of said current meshes an electronic switch having a first node towards the LED string and a second node opposed to the LED, connecting together the second nodes of all said electronic switches, coupling the first node of each said electronic switch to the first node of at least another one of said electronic switches via at least one current averaging, and selectively rendering only one of said electronic switches conductive at a respective given time interval thereby selectively distributing the current of said current generator to said LED strings, wherein said arrangement includes at least one pair of said LED strings, the method further comprising interposing at least one current averaging capacitor bridge-like between the LED strings in said pair, with respective inductors interposed between said current generator and said at least one current averaging capacitor.

2. The method of claim 1, further comprising rendering said switches conductive over respective time intervals, wherein the duration of said respective time intervals regulates the current distribution over said plurality of LED strings.

3. The method of claim 1, further comprising providing a single inductor coupled with a plurality of said current meshes.

4. The method of claim 1, further comprising providing a plurality of inductors each coupled with a respective one of said current meshes.

5. The method of claim 1, further comprising interposing said at least one inductor between said current generator and said plurality of LED strings.

6. The method of claim 1, further comprising providing said at least one inductor with said LED strings interposed between said current generator and said at least one inductor.

7. The method of claim 1, further comprising arranging said at least one current averaging capacitor coupling the first node of each said electronic switch to the first node of at least another one of said electronic switches:

in parallel with a respective LED string, or with said respective LED string interposed between said current generator and said at least one current averaging capacitor.

8. The method of claim 1, further comprising providing said electronic switches as controlled electronic switches.

9. The method of claim 1, wherein said plurality of LED strings includes at least one first LED string as well as a second LED string, wherein said second LED string has a voltage drop thereacross higher than said at least one first LED string, the method further comprising:

using an electronic controlled switch as the electronic switch associated with said at least one first LED string, and using a diode as the electronic switch associated with said second LED string.

10. An arrangement for driving a light source including a plurality of LED strings by means of a current generator, wherein each said LED string forms a respective current mesh with said current generator, the arrangement comprising:

at least one inductor acting on said current meshes, in each of said current meshes, an electronic switch having a first node towards the LED string and a second node opposed to the LED string, wherein the second nodes of all said electronic switches are connected together, and the first node of each said electronic switch is coupled to the first node of at least another one of said electronic switches via at least one current averaging capacitor, said electronic switches being selectively closeable each at a respective given time interval thereby selectively distributing the current of said current generator to said LED strings, wherein said arrangement includes at least one pair of said LED strings, the arrangement further comprising at least one current averaging capacitor interposed bridge-like between the LED strings in said pair, with respective inductors interposed between said current generator and said at least one current averaging capacitor.

* * * * *